US006041534A

United States Patent [19]

Buhler

[11] Patent Number: 6,041,534

[45] Date of Patent: Mar. 28, 2000

[54] OCCASIONAL STREAMERS

[76] Inventor: Don Buhler, 2035 53 Ave., Vero Beach, Fla. 32966

[21] Appl. No.: 09/025,552

[22] Filed: Feb. 18, 1998

[51] Int. Cl.[7] ..... G09F 21/04

[52] U.S. Cl. ..... 40/591; 40/600

[58] Field of Search ..... 40/591, 600, 604, 40/217, 214, 215, 412, 413, 422, 439, 590, 592, 597; 403/154, 161; 116/35 R, 41; 248/505; 73/170.05; 24/12, 3.13, 116 A; 63/1.11, 1.12, 1.13

[56] References Cited

U.S. PATENT DOCUMENTS

| | | | |
|---|---|---|---|
| 3,148,856 | 9/1964 | Orlando | 40/591 X |
| 3,670,438 | 6/1972 | Carroll et al. | 40/591 X |
| 4,049,165 | 9/1977 | Goldhaft | 24/3.13 X |
| 4,062,139 | 12/1977 | Klosel | 40/591 X |
| 4,822,197 | 4/1989 | DeMartino et al. | 403/154 |
| 4,876,981 | 10/1989 | Barnhart | 40/214 X |
| 5,027,539 | 7/1991 | Orsini | 40/413 X |
| 5,226,792 | 7/1993 | Parago | 40/600 X |
| 5,319,967 | 6/1994 | Rickards, Jr. | 73/170.05 X |
| 5,467,545 | 11/1995 | Zillner | 40/597 |
| 5,864,925 | 2/1999 | McGee | 24/3.13 X |

*Primary Examiner*—Joanne Silbermann

*Attorney, Agent, or Firm*—Brian S. Steinberger; Law Offices of Brian S. Steinberger

[57] ABSTRACT

Flexible and pliable magnetic panels with streamers for being attached to the sides of vehicles such as limousines and the like. The panels can be rectangular, bell shaped or pennant shaped, and include visible signage lettering such as the words "GOT MARRIED", "BAT MHIZVAH" and the like. Attached to front end portions of the panels are elongated thin plastic streamers, that are individually attached to the panels by nylon screws, washers and respective nuts. The panels and/or the streamers can be various colors such as red, white, blue, green, yellow, orange, brown, black, and combinations thereof.

18 Claims, 7 Drawing Sheets

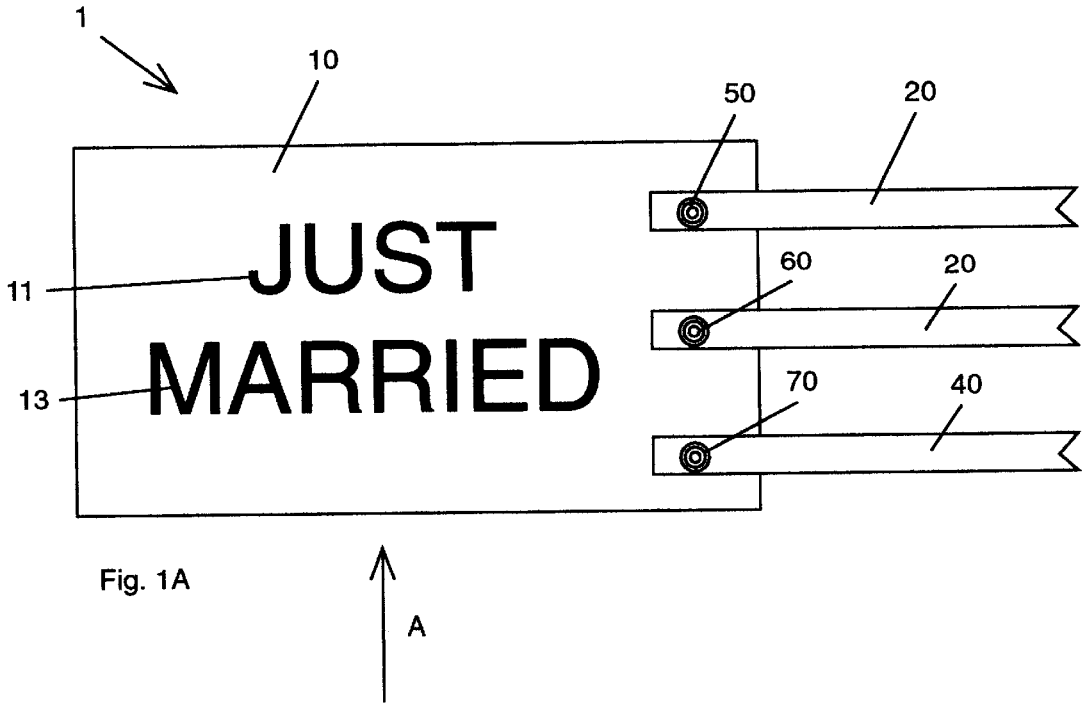
Fig. 1A
Fig. 1B
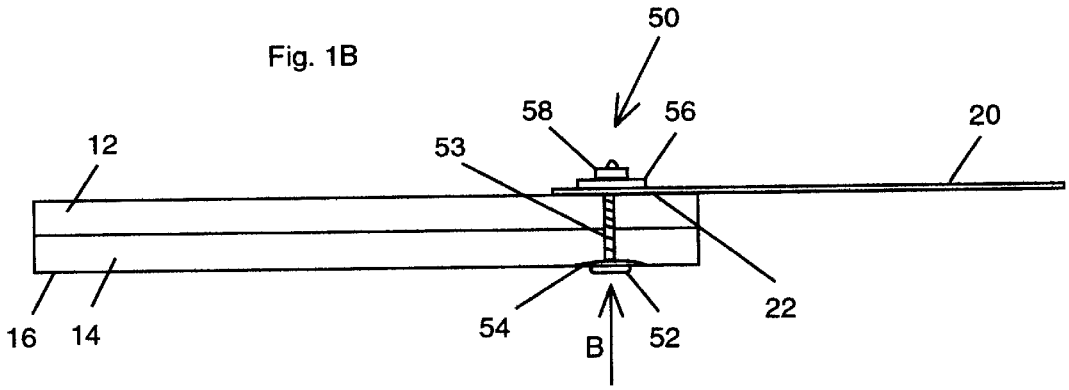
Fig. 1C
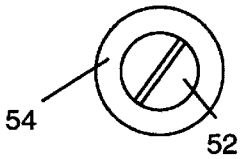

610

650

Fig. 7A
705
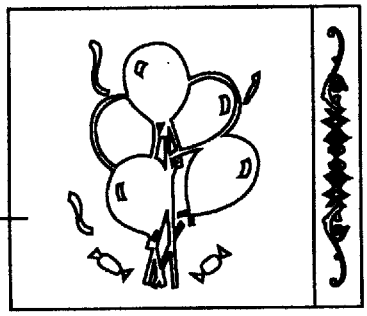
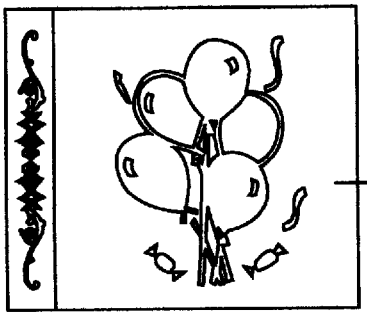
Fig. 7B
710
Fig. 7C
715
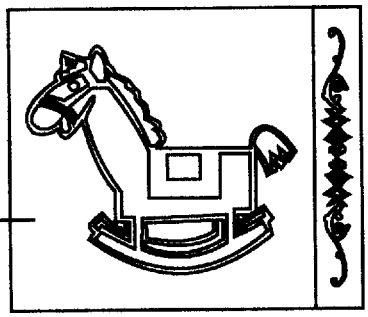
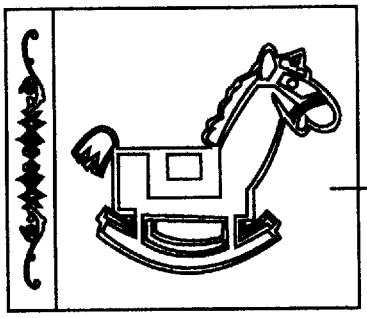
Fig. 7D
720
Fig. 7E
725
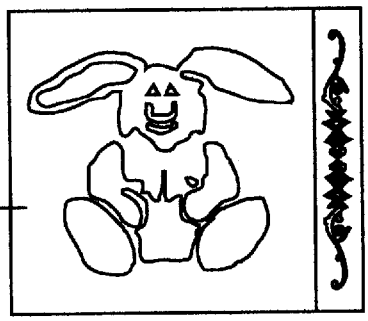
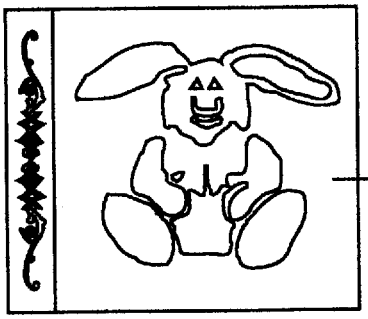
Fig. 7F
730
Fig. 7G
735
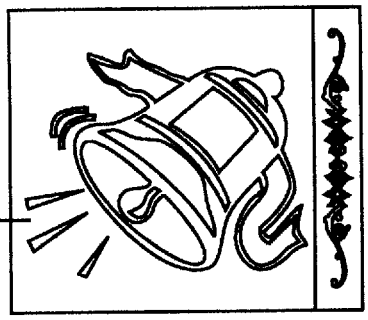
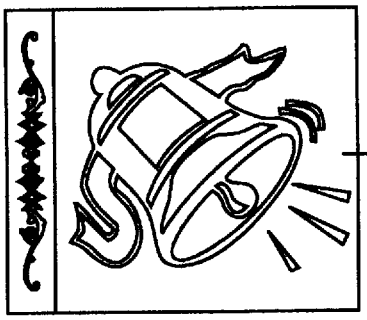
Fig. 7H
740
Fig. 7I
745
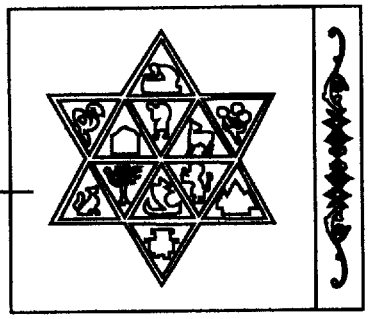
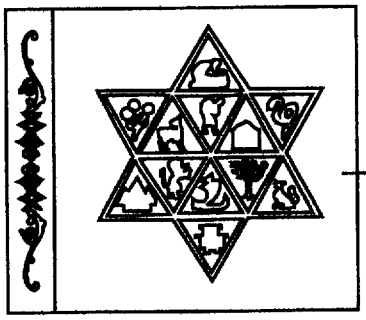
Fig. 7J
750

810

820

OCCASIONAL STREAMERS

This invention relates to signs, and in particular to a sign apparatus for being attached to the sides of vehicles by magnet panels with streamer attachments.

BACKGROUND AND PRIOR ART

Vehicles such as limousines, and automobiles have been decorated over the years with crepe paper type streamers to celebrate special functions such as weddings and the like. However, there have been numerous problems with attaching crepe paper type streamers. For example, the usual crepe paper streamer is made out of a thin paper that easily rips and tears when passing through wind, rain and other weather conditions, and become flying unsitely trash. Furthermore, the crepe type paper attachment streamers have must be tied and/or taped to various surfaces such as antennas, bumpers, doorknobs, and painted surfaces. Besides the time consuming activity of attaching these crepe type streamers, it can be very difficult to remove all the remaining pieces after being used. The problem is further compounded if tape is used to secure the crepe type paper to painted surfaces, where removing the tape can also remove portions of the painted surface itself.

Thus, there exists a need to provide solutions to the above problems with using streamers.

SUMMARY OF THE INVENTION

The first objective of the present invention is to provide a flexible magnetic board for attaching streamers that can be easily attached and detached to the sides of a vehicle.

The second object of this invention is to provide a flexible magnetic board with attached streamers that do not tear off and detach while the vehicle is moving.

A preferred embodiment of the streamer apparatus for vehicles includes a flexible panel having a front side with signage lettering such as "JUST MARRIED" and a rear side having a magnetic surface. Plastic elongated streamers are attached for connecting one end of each of the streamers to edge portions of the flexible panel, wherein the magnetic surface is attached to a vehicle so that the streamers become extended when the vehicle moves. The flexible panel can be a rectangular outer shape of approximately 12 inches by approximately 24 inches. The flexible panel can include other shapes such as bell shape, pennant shape, and the like. The attachment includes a nylon screw and nylon washer for attaching each of the streamers to the panel. Another attachment version has a ring attached to both the screw and each of the streamers. The streamers can be attached to the right edges, the left edges, and the bottom edges of the panel.

Further objects and advantages of this invention will be apparent from the following detailed description of a presently preferred embodiment which is illustrated schematically in the accompanying drawings.

BRIEF DESCRIPTION OF THE FIGURES

FIG. 1A is a front view of a preferred embodiment of the novel occasional streamer invention.

FIG. 1B is an enlarged side view of the embodiment of FIG. 1A along arrow A.

FIG. 1C shows a bottom view of the streamer attachment screw of FIG. 1B along arrow B.

FIG. 7A shows a balloon picture sign embodiment for the right side of a vehicle.

FIG. 7B shows the sign embodiment of FIG. 7A for the left side of a vehicle.

FIG. 7C shows a horse picture sign embodiment for the right side of a vehicle.

FIG. 7D shows the sign embodiment of FIG. 7C for the left side of a vehicle.

FIG. 7E shows a bunny picture sign embodiment for the left side of a vehicle.

FIG. 7F shows the sign embodiment of FIG. 7E for the right side of a vehicle.

FIG. 7G shows a bell picture sign embodiment for the left side of a vehicle.

FIG. 7H shows the sign embodiment of FIG. 7G for the right side of a vehicle.

FIG. 7I shows a STAR of DAVID picture sign embodiment for the left side of a vehicle.

FIG. 7J shows the sign embodiment of FIG. 7I for the right side of a vehicle.

DESCRIPTION OF THE PREFERRED EMBODIMENT

Figure 2:
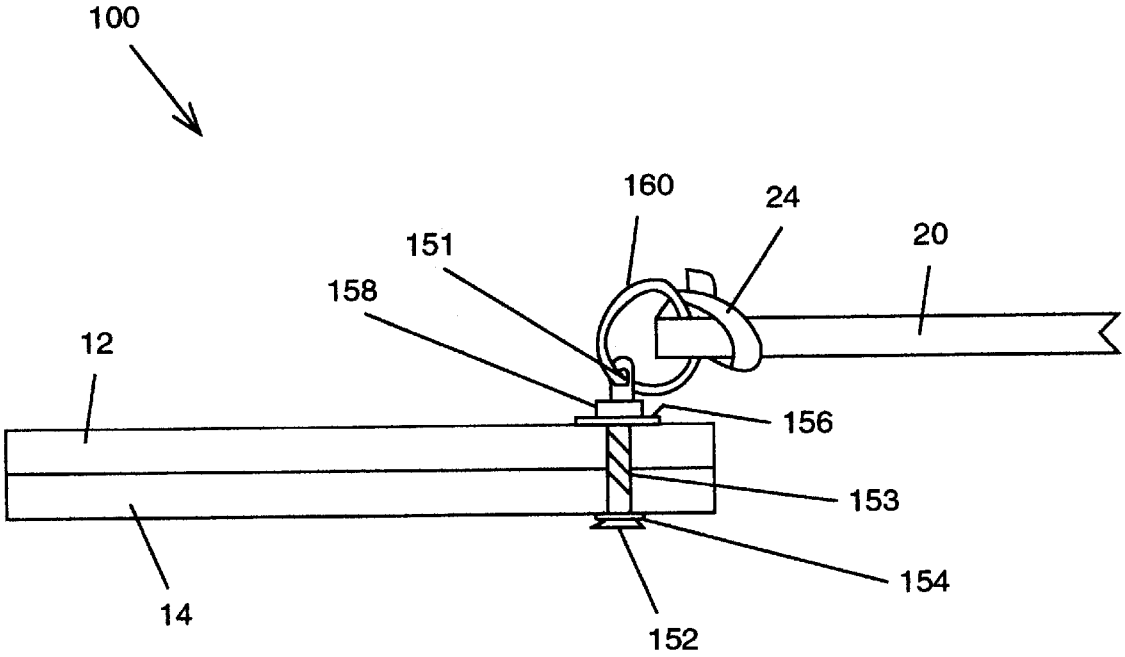
FIG. 2 shows a side view of another attachment connection for use with the rectangular embodiment of FIG. 1A.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

FIG. 1A is a front view 1 of a preferred rectangular panel embodiment of the novel occasional streamer invention. FIG. 1B is an enlarged side view of the embodiment 1 of FIG. 1A along arrow A. FIG. 1C shows a bottom view of the streamer attachment screw of FIG. 1B along arrow B. Referring to FIGS. 1A–1C, embodiment 1 includes a rectangular type panel 10 that can dimensions of approximately 12 inches by approximately 24 inches, having a top layer 12 of approximately 2 mil thick metallic vinyl which having a reflective type surface 11 with colors such as but not limited to yellow, green, blue, orange, red, brown, black, brown, and variations thereof, as well as other reflective features such as sparkles, glitter, and the like. Such a vinyl layer can be the Color Advantage Computer graphic films manufactured by Spar-Cal. On top to surface 11 can be signage lettering 13 which can include words such as "JUST MARRIED" and "BAR MITZVAHED", and other words for celebrations, as well as figures such as "CAKES", and the like. The bottom layer 14 can be an approximately 0.030 mil thick rubber magnetized sheet that adhered to layer 12 by adhesive, heating, and the like. Along one side of the panel 10 are three attachment fasteners 50, 60, 70 for supporting narrow thin strips 20, 30, 40 each being approximately two to approximately four feet in length as streamers, which can be formed of very thin plastic, vinyl, and the like. Each of the attachment points 50, 60, and 70 are shown in FIGS. 1B–1C, where a flat regular headed screw 53 such as a nylon, or plastic screw with a flat head 52 holding a washer 54(such as a nylon, plastic and the like) flush against the bottom surface 16 and a nut 58(such as nylon, plastic, and the like) holding streamer end 22 the latter sandwiched between top washer 56 and top layer 12. Screws 53 can be approximately 5/16 inch by ½ inch, 5/18 inch by ½ inch and the like, in size.

FIG. 2 shows a side view of another attachment connection 100 for use with the rectangular embodiment 1 of FIG. 1A. Version 100 has screw 152, 153, washers 152, 156, nut 158 that correspond to like components described previously. Referring to FIG. 2, screw 153 has an upper tip end with a through-hole 151 having an approximately diameter of 5/32 inch drilled there-through, so that a metal key chain ring 160 can be inserted therein. Streamer 20 has an end 24 knot tied to chain ring 160.

Figure 3:
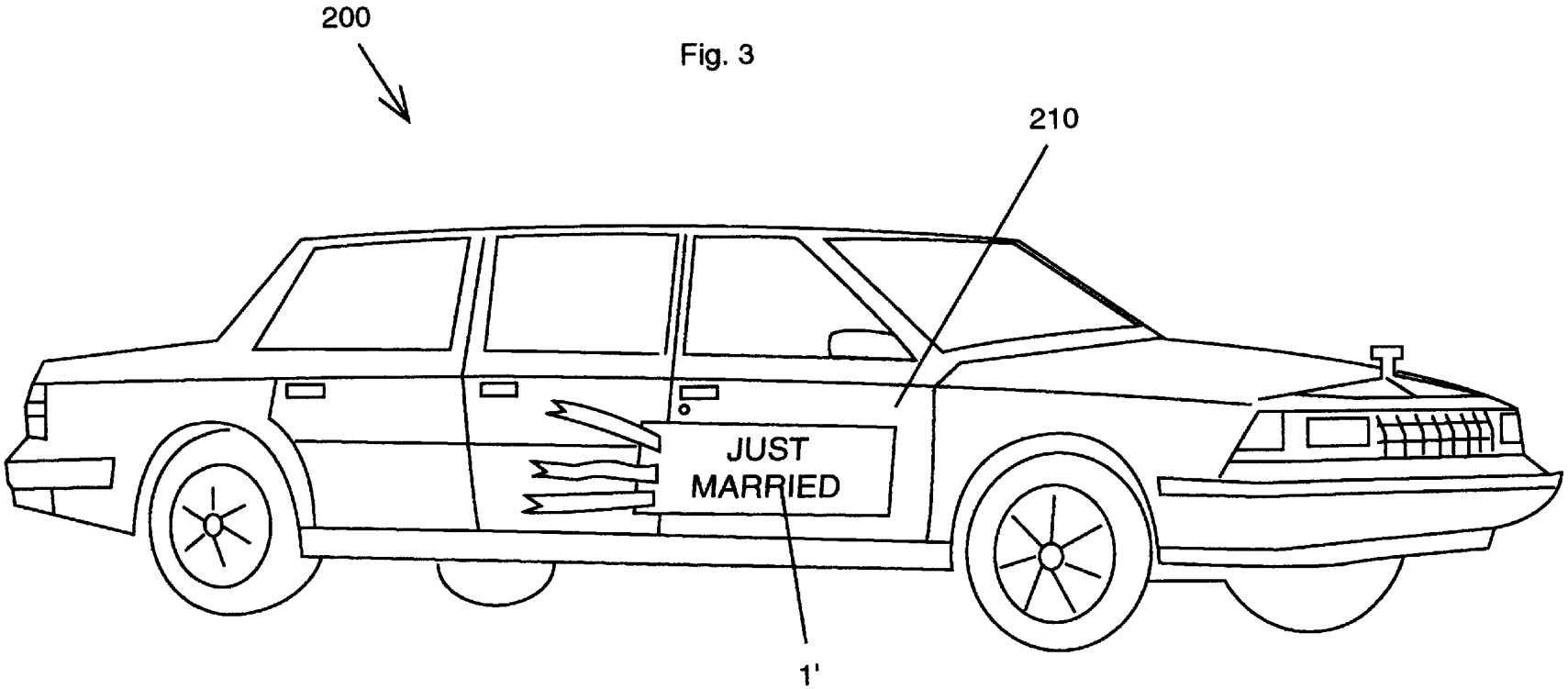
FIG. 3 shows the embodiment of FIG. 1A attached to the side of a limousine.

FIG. 3 shows the embodiment 1 of FIG. 1A attached to the side door 210 of a limousine 200. The magnetic surface layer 14 of FIG. 1A allows the panel 1' to closely adhere to the metal side door panel 210. Note that FIG. 3 shows a left sided streamer panel 1', while FIG. 1A represents the panel having right extending streamers.

Figure 4:
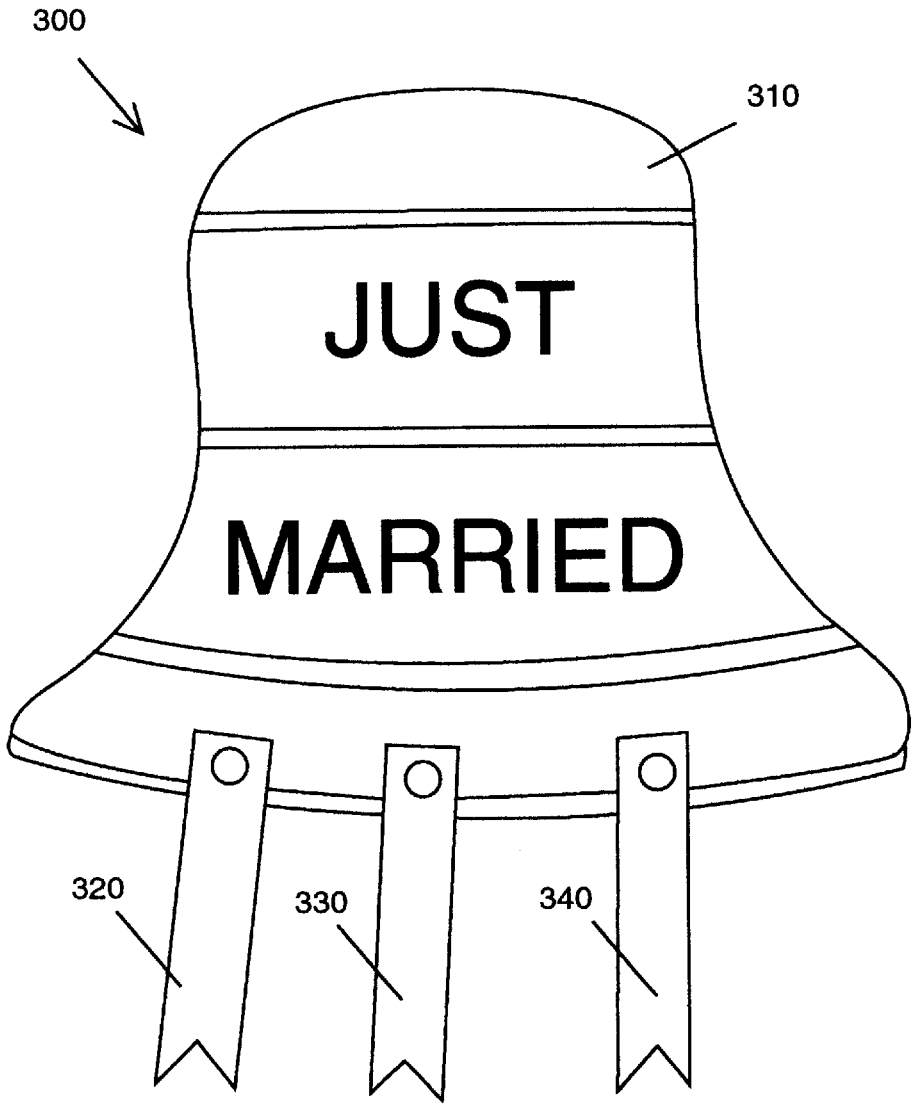
FIG. 4 shows another preferred embodiment of the occasional streamer invention in a bell shape.

FIG. 4 shows another preferred embodiment 300 of the occasional streamer invention in a bell shape 310 having bottom edge attached streamers 320, 330, 340. Similarly, embodiment 300 can be attached to the left side, right side and rear sides of a vehicle such as a limousine and the like.

Figure 5:
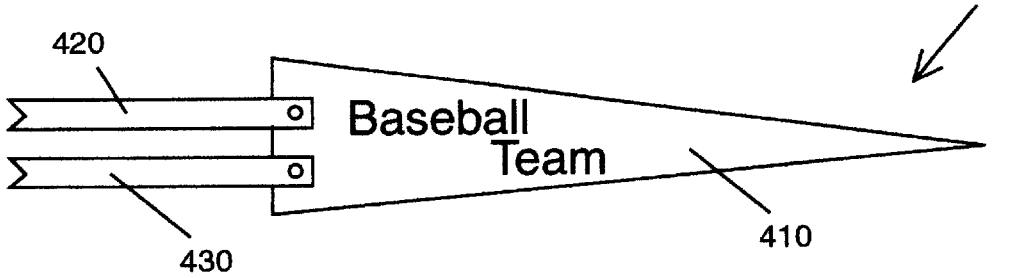
FIG. 5 shows still another preferred embodiment of the streamer invention in a pennant shape.

FIG. 5 shows still another preferred embodiment 300 of the streamer invention in a pennant shape 410 also having attached streamers 420, 430 connected in a similar fashion to the embodiments previously described.

Figure 6A:
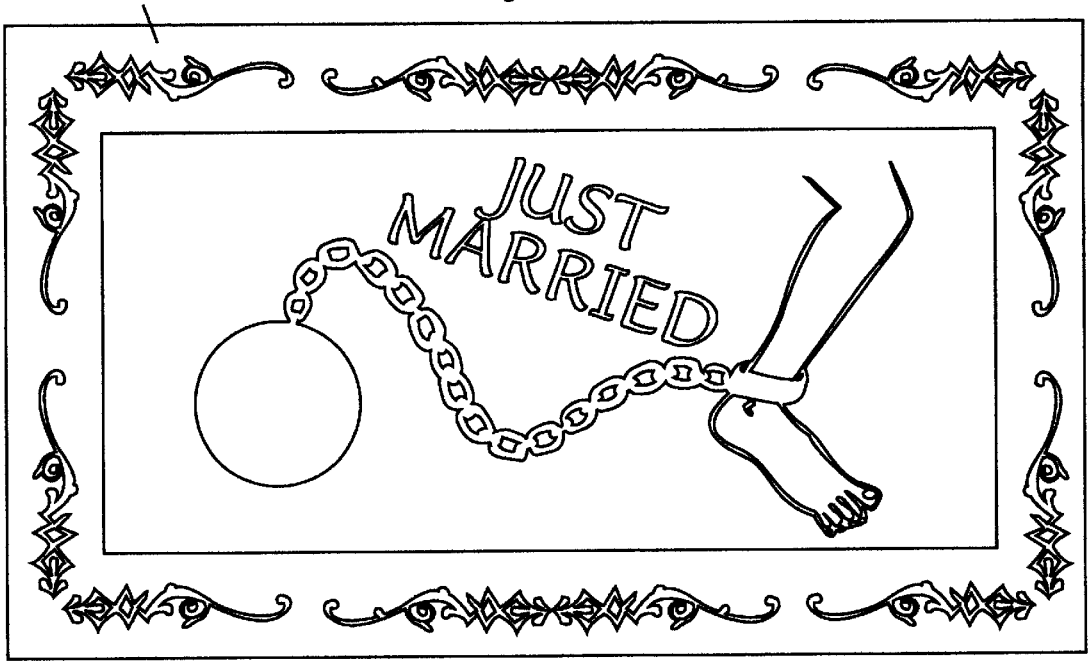
FIG. 6A is another preferred embodiment of a JUST MARRIED sign for the left side of a vehicle.
Figure 6B:
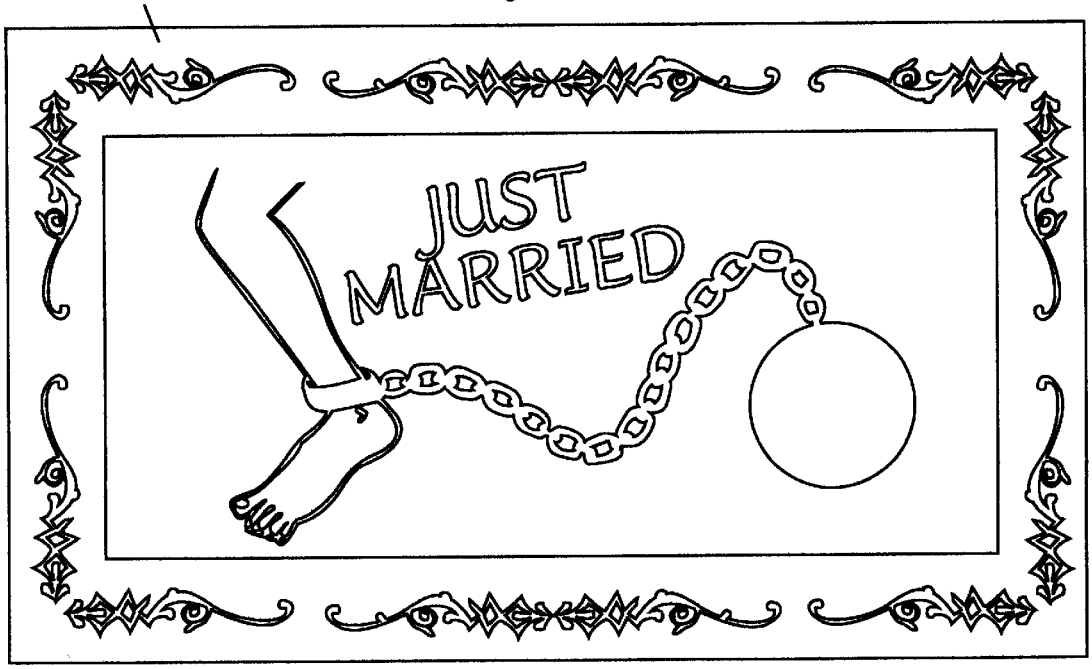
FIG. 6B shows the JUST MARRIED embodiment of FIG. 6A for the right side of a vehicle.

FIG. 6A is another preferred embodiment 610 of a JUST MARRIED sign with a ball and chain logo for attachment to the left side of a vehicle. FIG. 6B shows the JUST MARRIED embodiment 650 of FIG. 6A for the right side of a vehicle.

FIG. 7A shows a balloon picture sign embodiment 705 for attachment to the right side of a vehicle. FIG. 7B shows the sign embodiment 710 of FIG. 7A for the left side of a vehicle. FIG. 7C shows a horse picture sign embodiment 715 for the right side of a vehicle. FIG. 7D shows the sign embodiment 720 of FIG. 7C for the left side of a vehicle. FIG. 7E shows a bunny picture sign embodiment 725 for the left side of a vehicle. FIG. 7F shows the sign embodiment 730 of FIG. 7E for the right side of a vehicle. FIG. 7G shows a bell picture sign embodiment 735 for the left side of a vehicle. FIG. 7H shows the sign embodiment 740 of FIG. 7G for the right side of a vehicle. FIG. 7I shows a STAR of DAVID picture sign embodiment 745 for the left side of a vehicle. FIG. 7J shows the sign embodiment 750 of FIG. 7I for the right side of a vehicle. Alternatively, other religious signs can be used. FIGS. 7A–7J cover six inch by seven inch accent size sign embodiments.

Figure 8A:
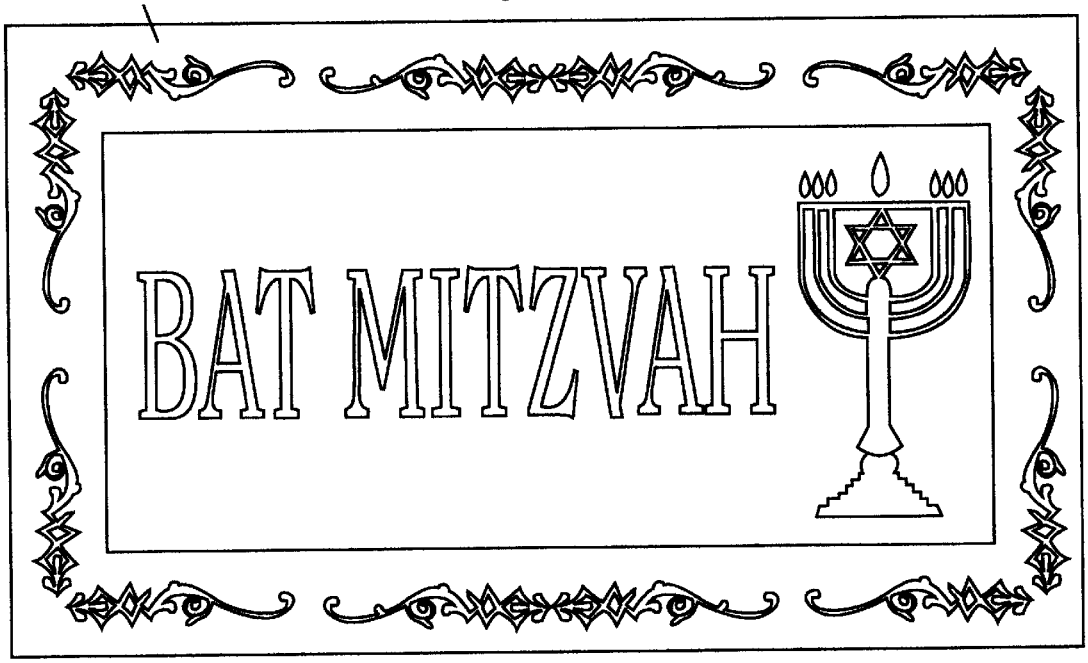
FIG. 8A shows a BAT MITZVAH sign embodiment for the right side of a vehicle.
Figure 8B:
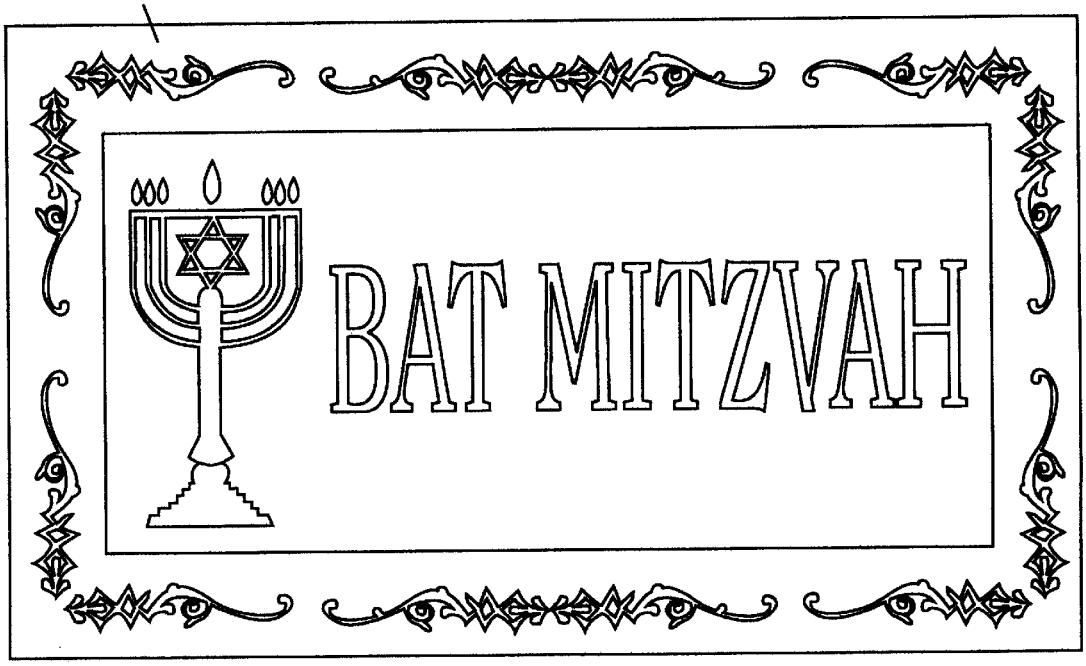
FIG. 8B shows the sign embodiment of FIG. 8A for the left side of a vehicle.

FIG. 8A shows a BAT MITZVAH sign embodiment 810 for the right side of a vehicle. FIG. 8B shows the sign embodiment 820 of FIG. 8A for the left side of a vehicle. Alternatively, the words BAR MITZVAH can be used as well.

All the embodiments described above can be packaged in sets having left side, right side, and rear vehicle positionable signs.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A streamer apparatus for vehicles, comprising in combination:

a flexible panel having a front side with signage lettering and a rear side having a magnetic surface;

a plastic elongated streamer;

an attachment means for connecting one end of the streamer to an edge portion of the flexible panel, the attachment means includes a fastener having a substantially flat head end and an elongated protruding portion;

means located on the front side of the panel for holding the streamer to the elongated protruding portion of the fastener; and a vehicle having a metal surface portion, wherein the magnetic surface of the flexible panel is attached to the metal surface portion of the vehicle so that the streamer becomes extended when the vehicle moves, the flat head end being positioned on the rear side of the flexible panel so that the rear side of the panel and the flat head are flush against the surface portion of the vehicle.

2. The streamer apparatus of claim 1, wherein the flexible panel includes:

a rectangular outer shape.

3. The streamer apparatus of claim 2, wherein the rectangular shape includes dimensions of:

approximately 12 inches by approximately 24 inches.

4. The streamer apparatus of claim 1, wherein the flexible panel includes:

a bell shape.

5. The streamer apparatus of claim 1, wherein the flexible panel includes:

a pennant shape.

6. The streamer apparatus of claim 1, wherein the signage lettering includes the message:

just married.

7. The streamer apparatus of claim 1, wherein the holding means is chosen from at least one of:

a washer and a nut, wherein the holding means fits about the protruding portion of the fastener, and a portion of the streamer is sandwiched between the holding means and the flat head end of the fastener.

8. The streamer apparatus of claim 1, wherein the holding means includes:

a ring attached to the protruding portion of the fastener, wherein a portion of the streamer is connected to the ring.

9. The streamer apparatus of claim 1, wherein the edge portion is:

a right edge of the panel.

10. The streamer apparatus of claim 1, wherein the edge portion is:

a left edge of the panel.

11. The streamer apparatus of claim 1, wherein the edge portion is:

a bottom edge of the panel.

12. The streamer apparatus of claim 1, wherein the signage lettering includes the message:

Bar Mitzvah.

13. The streamer apparatus of claim 1, wherein the signage lettering includes the message:

Bat Mitzvah.

14. The streamer apparatus of claim 1, wherein the signage lettering includes the image:

balloons.

15. The streamer apparatus of claim 1, wherein the signage lettering includes the images of:

an animal.

16. The streamer apparatus of claim 1, wherein the signage lettering includes the image of:

a religious sign.

17. A streamer and panel attachment apparatus, comprising in combination:

a flexible magnetic panel having a front side and a rear side;

an elongated streamer;

a fastener for attaching the streamer to the panel, the fastener having a head end being located on the rear side of the panel, the fastener having a protruding portion with a threaded end that passes through the panel and exits on the front side of the panel;

a nut having internal threads which mateably connects to the threaded end of the fastener for attaching a portion of the streamer between the nut and flat head end of the fastener; and a vehicle having a metal surface portion, wherein the rear side of the magnetic panel is positioned over the metal surface portion of the vehicle, allowing the rear surface of the panel with the head end of the fastener to lay substantially flush against the metal surface portion of the vehicle.

18. A streamer and panel attachment apparatus, comprising in combination:

a flexible magnetic panel having a front side and a rear side;

an elongated streamer;

a fastener for attaching the streamer to the panel, the fastener having a head end being located on the rear side of the panel, the fastener having a protruding portion that passes through the panel and exits on the front side of the panel;

a ring connected to the protruding portion of the fastener located on the front side of the panel for attaching a portion of the streamer thereto; and a vehicle having a metal surface portion, wherein the rear side of the magnetic panel is positioned over the metal surface portion of the vehicle, allowing the rear surface of the panel with the head end of the fastener to lay substantially flush against the metal surface portion of the vehicle.

* * * * *